US007791263B2

(12) United States Patent
Dijon

(10) Patent No.: US 7,791,263 B2
(45) Date of Patent: Sep. 7, 2010

(54) ELECTRON EMITTING STRUCTURE BY FIELD EFFECT, WITH EMISSION FOCUSSING

(75) Inventor: Jean Dijon, Champagnier (FR)

(73) Assignee: Commissariat a l'Energie Atomique, Paris (FR)

( * ) Notice: Subject to any disclaimer, the term of this patent is extended or adjusted under 35 U.S.C. 154(b) by 152 days.

(21) Appl. No.: 12/024,455

(22) Filed: Feb. 1, 2008

(65) Prior Publication Data

US 2008/0203887 A1 Aug. 28, 2008

(30) Foreign Application Priority Data

Feb. 6, 2007 (FR) ..... 07 53086

(51) Int. Cl.
*H01J 17/49* (2006.01)

(52) U.S. Cl. ..... 313/495; 313/310

(58) Field of Classification Search ..... 313/309, 313/336, 351, 495
See application file for complete search history.

(56) References Cited

U.S. PATENT DOCUMENTS 6,437,503 B1 8/2002 Konuma

FOREIGN PATENT DOCUMENTS

EP 1 594 150 A1 11/2005
FR 2 873 852 A1 2/2006

*Primary Examiner*—Vip Patel
(74) *Attorney, Agent, or Firm*—Oblon, Spivak, McClelland, Maier & Neustadt, L.L.P.

(57) ABSTRACT

An electron emitting structure that emits electrons by field effect, including: at least one electronic emission zone indicated by a cathode electrode positioned according to a first axis and an extraction gate electrode positioned in a second axis, with an electrical insulating layer separating the cathode electrode from the gate electrode, wherein the electronic emission zone includes a plurality of electron emitting elements electrically connected to the cathode electrode, wherein the electron emitting elements are disposed in rows in openings in the gate electrode and the electrical insulating layer, the gate openings are disposed in rows between two bands of the gate electrode; and focussing means for focusing electronic beams emitted by the electron emitting elements.

9 Claims, 7 Drawing Sheets

ELECTRON EMITTING STRUCTURE BY FIELD EFFECT, WITH EMISSION FOCUSSING

TECHNICAL FIELD

The invention relates to an electron emitting structure for a field effect device. It relates to the focussing of the electronic emission.

STATE OF THE PRIOR ART

The divergence of electronic beams is an important quality criterion for field emitting screens. In fact, this divergence controls the resolution of the screens that may be made, the purity of the colours, the luminosity and also the uniformity of the emission.

The document FR-A-2 836 279 discloses a cathode structure for an emitting screen. The cathode structure is of the triode type, which is to say that it comprises an electron extraction gate. The gate is an electrode equipped with openings. To restrict the divergence of the electron beam, the electron emitting elements are located in the central section of each gate opening. This structure is well suited to the use of nanotubes as electron emitting elements.

FIG. 1 is a perspective and very partial view of a cathode structure disclosed by document FR-A-2 836 279. The cathode structure comprises a substrate 1, for example made of glass, successively supporting a cathode electrode 3, a resistive layer 2, a dielectric layer 4 and an extraction gate electrode 5. An opening 6 made in the gate electrode 5 and the dielectric layer 4 reveals the resistive layer 2 supporting the electron emitting elements 7 in carbon nanotubes. The emitting elements are positioned symmetrically with respect to the two parts of the gate electrode 5 so that the lateral component of the electrical field, which is one of the causes of the divergence of the electron beam, is minimal.

FIG. 2 is a top view of the structure of an image element (or pixel) made according to the information from document FR-A-2 836 279. FIG. 1 is a view corresponding to the section I-I of FIG. 2.

FIG. 2 shows the gate electrode 5 equipped with slots 6 revealing electron emitting elements 7 supported by the resistive layer 2. Even though it may not be seen in the top view, a cathode electrode 3 has also been started.

The dissymmetry of the structure in X and Y means that the divergence is lower along the axis of the slots 6 than along the X axis perpendicular to the slots. Reference 8 shows the form of the electronic spot from an electron emitting element 7.

Document FR-A-2 873 852 proposed an improvement to document FR-A-2 836 279. This improvement consists of turning the slots of the gate electrode by 90° so that these slots are perpendicular to the Red-Green-Blue bands of the luminophores positioned on an anode opposite the cathode structure. The slots are therefore positioned perpendicularly to the columns formed by the cathode electrodes.

FIG. 3 shows three pixels of a cathode structure according to document FR-A-2 873 852. The pixels shown result from the crossing of cathode electrodes 13 and gate electrodes 15. The slots 16 of the gate electrodes are positioned perpendicularly to the cathode electrodes 13. The references 18 designate electronic spots from electron emitting elements 17. It may be seen that there is significant interline mixing of the electronic beams. Nevertheless, with this structure, there is still high divergence in the Y axis, a divergence which is translated by a loss of useful electrons for the pixel and by random fluctuations of brightness from pixel to pixel. These fluctuations are due to a mixture of the electrons from the pixels next to the pixel in question (see FIG. 3).

The purpose of the present invention is to minimise this problem.

SUMMARY OF THE INVENTION

The subject matter of the invention is a structure emitting electrons by field effect that is of the triode type, comprising at least one electronic emission zone resulting from the crossing of a cathode electrode positioned according to a first axis and an extraction gate electrode positioned according to a second axis, wherein an electrical insulating layer separates the cathode electrode from the gate electrode, and the electronic emission zone comprises a plurality of electron emitting elements electrically connected to the cathode electrode, wherein the electron emitting elements are positioned in rows in openings made in the gate electrode and the electrical insulating layer, wherein the gate openings are positioned in rows and each gate opening is positioned between two gate electrode bands, wherein the structure also comprises means of focussing the electronic beams emitted by the electron emitting elements, characterised in that the focussing means are formed by a dissymmetrical layout of rows of electron emitting elements and their adjacent gate electrode bands, and the dissymmetry is organised so that it focuses all of the electronic beams and results from a difference in width of gate electrode bands to an adjacent same gate opening so that, for this gate opening, the adjacent band positioned the closest to the outside of the electronic emission zone is narrower than the adjacent band positioned the closest to the inside of the electronic emission zone.

The difference in width of the electrode bands may be such that the width of the bands progressively decreases from the inside towards the outside of the electronic emission zone. The gate electrode may have, in the central section of the electronic emission zone, at least one gate opening whose adjacent bands have equal widths, wherein the electrode bands of progressively decreasing width are positioned on either side of this central section.

According to a second embodiment of the invention, the dissymmetry results from an offset of at least one row of electron emitting elements with respect to the main axis of the gate opening corresponding to this row, wherein the offset consists of bringing said row closer to the centre of the electronic emission zone. As the dissymmetry results from the offset of several rows of electron emitting elements, the offset may increase progressively from the inside towards the outside of the electronic emission zone. Consequently, the gate electrode may have, in the central section of the electronic emission zone, at least one gate opening whose row of electron emitting elements is centred on its main axis, wherein the offset rows of electron emitting elements increase progressively as they are positioned on either side of this central section.

The gate electrode bands may be orientated according to the first axis or according to the second axis.

BRIEF DESCRIPTION OF THE DRAWINGS

The invention will be more clearly understood and other advantages and specific features will become apparent upon reading the following description, provided by way of non-restrictive example, accompanied by appended drawings among which.

DETAILED DESCRIPTION OF SPECIFIC EMBODIMENTS

The invention will now be explained, comparing an electron emitting structure of the triode type according to the prior art, illustrated by FIG. 4, and an electron emitting structure of the triode type, used by the invention and illustrated by FIG. 5.

Figure 1:
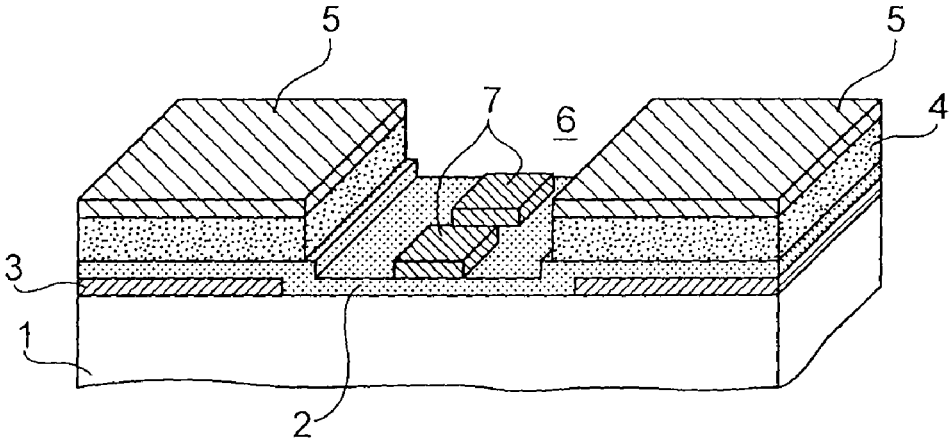
FIG.1 PRIOR ART
FIG. 1 is a perspective and very partial view of a cathode structure of the triode type according to the prior art.
Figure 4:
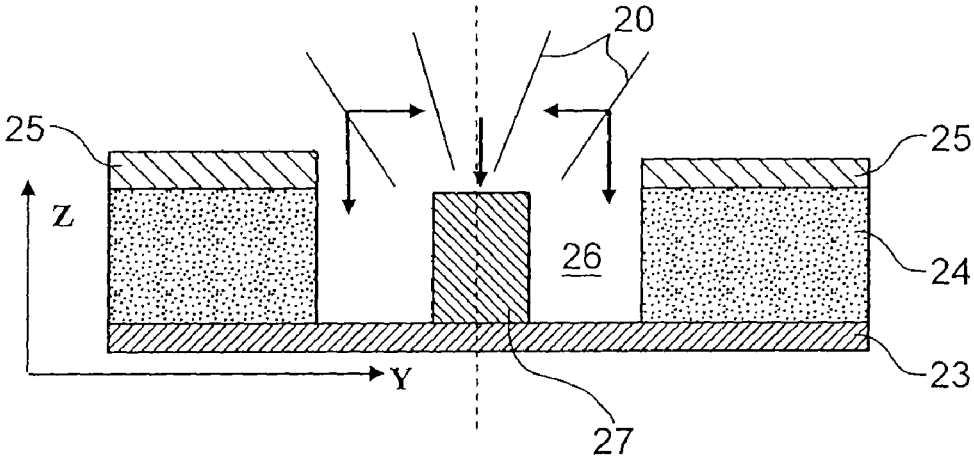
FIG.4 PRIOR ART
FIG. 4 shows diagrammatically an electron emitting structure, of the triode type, according to the prior art.

FIG. 4 shows a cathode electrode 23 successively supporting a dielectric layer 24 and a gate electrode 25. An opening 26 is made in the gate electrode 25 and the dielectric layer 24 to reveal the cathode electrode 23. Positioned in the centre of the opening 26 and in electrical contact with the cathode electrode 23 is an electron emitting element 27. The electron emitting element may be in electrical contact with the cathode electrode by means of a resistive layer (or ballast layer) as is the case illustrated by FIG. 1. Conventionally, the opening 26 separates the gate electrode 25 into two parts (left and right of the line) electrically connected to one another.

Arrows show the horizontal (in the Y axis) and vertical (in the Z axis) electrical field components that are generated when the cathode structure operates. Reference 20 shows electronic trajectories. As the structure is symmetrical (emitting element positioned in the centre of the opening, left and right sides of gate electrode of same width), the zone where the electrical field is vertical corresponds to the centre of the emitting element. The electrons emitted on either side of the vertical field line diverge in the same way on either side of the vertical field line.

Figure 5:
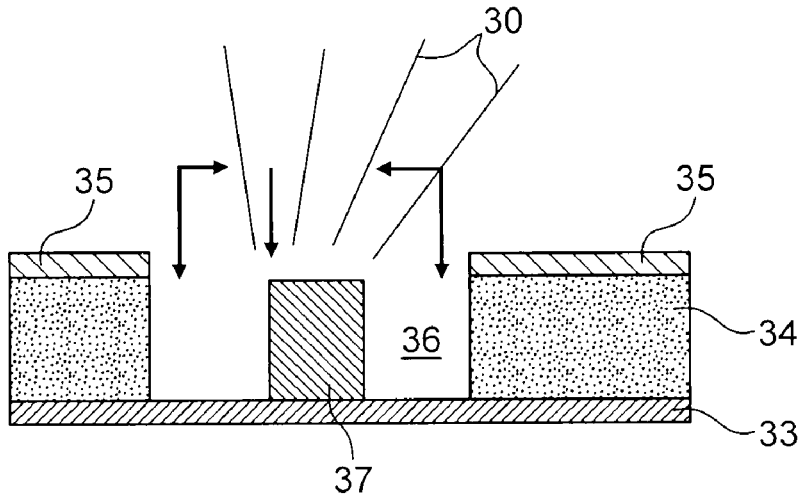
FIG. 5 shows diagrammatically an electron emitting structure, of the triode type, that is part of an image element with multiple electron emitting elements.

FIG. 5 shows a cathode structure that is practically identical to that of FIG. 4: cathode electrode 33, dielectric layer 34, gate electrode 35, opening 36 and electron emitting element 37. One essential difference concerns the dissymmetry of width between the left and right sides of the gate electrode 35. In the case of FIG. 5, the right side of the gate electrode is wider than the left side.

The result of this dissymmetry is that the vertical field line is no longer situated in the centre of the electron emitting element. This line is offset on the narrowest side of the gate electrode. The electrodes therefore have trajectories 30 that are essentially directed from the side opposite the narrowest side of the gate electrode.

The present invention proposes, in a first embodiment, to make a pixel structure featuring extraction gate widths that are increasingly narrower the further they are from the centre of the pixel. It is thus possible to create a structure that tends to focus the electrons towards the centre of the pixel.

Figure 6:
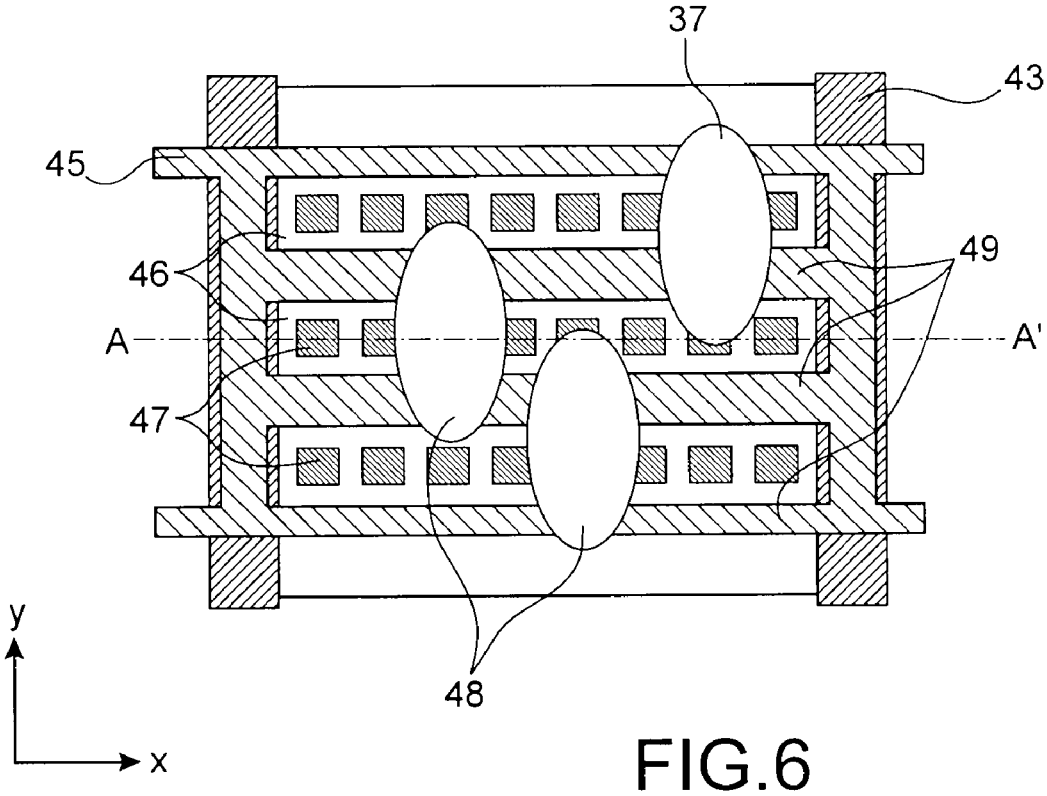
FIG. 6 is a top view of a pixel according to a first embodiment of the invention.

FIG. 6 is a top view of a pixel according to the first embodiment of the invention. A cathode electrode 43 and an extraction gate electrode 45 equipped with openings 46 in the form of slots may be seen. Each slot 46 reveals a row of electron emitting elements 47 electrically connected to the cathode electrode 43 by means of a resistive layer (or ballast layer) 42. The slots 46 are separated from one another by bands 49. The pixel structure defined by the intersection of the cathode electrode 43 and the gate electrode 45 has a straight symmetry axis of AA' directed according to the axis of the gate electrode. It may be remarked on this structure that the widths of the bands 49 are increasingly narrower the further they are from the AA' line. Reference 48 designates electronic spots from electron emitting elements 47. The electronic spot 48 from an electron emitting element 47 located on the AA' axis is centred on this element as there is a symmetry at the AA' axis between the electron emitting elements and the adjacent bands 49 which have the same width. On the other hand, the electronic spots 48 from the electron emitting elements 47 located in slots 46 that are not centred on the AA' axis are off centre due to the narrower width of the bands 49 the furthest away from the AA' axis. The excentricity of these spots causes the focussing of all the electronic spots from the pixel.

Figure 2:
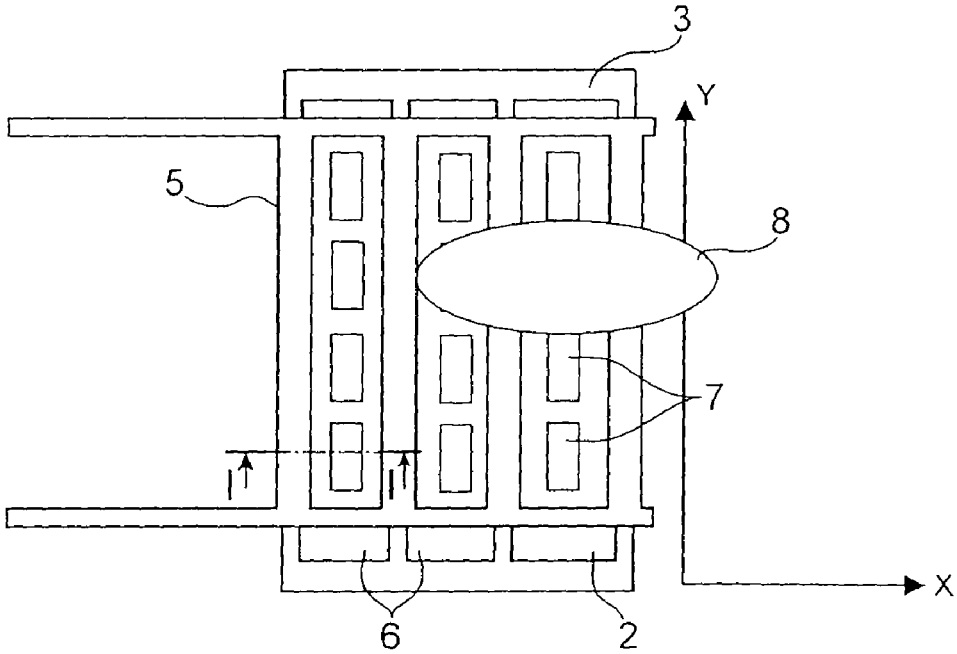
FIG.2 PRIOR ART
FIG. 2 is a top view of the structure of an image element for a viewing screen, according to the prior art.
Figure 3:
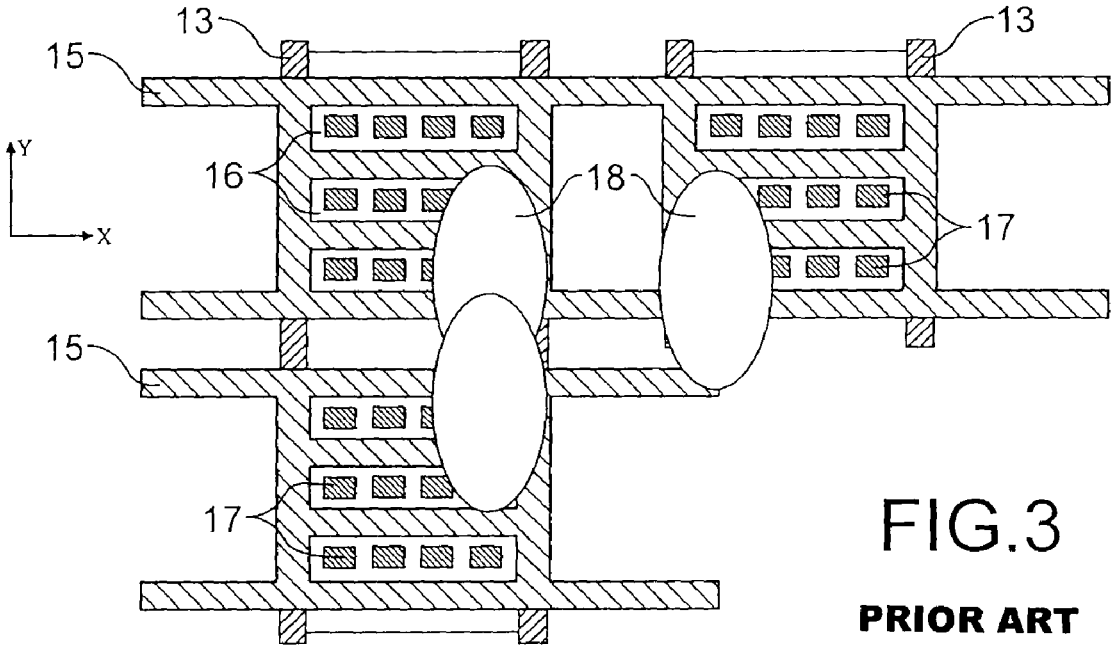
FIG.3 PRIOR ART
FIG. 3 is a top view of three image elements of a cathode structure according to the prior art, as well as electronic spots from electron emitting elements of these image elements.

Obviously, the structure of a pixel generally comprises a much higher number of gate electrode bands. In this case, to obtain focussing that is more appropriate for the pixel, a band width gradient is made along the Y axis (see FIG. 6), starting from the central figure of the pixel, formed by the AA' axis when the gate electrode bands are orientated along the axis X (axis of the gate electrode). Similarly, if the gate electrode bands are orientated along the Y axis (as illustrated in FIG. 2, where Y is the axis of the cathode electrode), in this case a band width gradient is made along the X axis (axis of the gate electrode).

Figure 7:
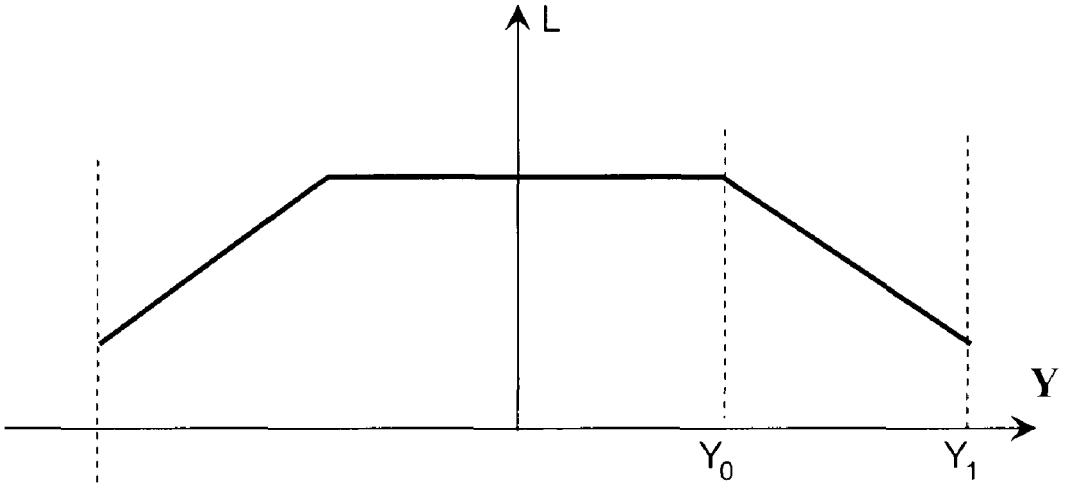
FIG. 7 is a diagram showing one example of a width profile of the bands of an extraction gate electrode along the Y axis of a pixel, according to the invention.

FIG. 7 shows one example of a profile of the width L of the bands of a gate electrode along the Y axis for a pixel of a viewing screen. The axis of the ordinates, showing the width L, is positioned on the central line of the pixel. In this example, there is a first zone where the gate electrode bands are of constant width up to a distance $Y_0$ from the central line which substantially corresponds to $(h_{/2}-d)$ where h is a dimension of the pixel corresponding to a gate electrode, d is the overspill of the electronic beam, where $d=g.tg\ \theta$, where g is the distance separating the anode from the cathode of the viewing screen and $\theta$ is the half-divergence of the electronic beam. The gradient subsists up to the $Y_1$ value representing the edge of the emitting zone of the pixel.

Of course, it is not obligatory to use a linear gradient and any form of profile may be used which optimises the focussing. In particular, it is advantageous to focus more on the edges than close to the centre, therefore a parabolic gate width profile for example is also very interesting or a profile which permits the brightness of the pixel to be optimised. The last band (the closest to the outside) may be of zero width.

The advantage in using variable width bands, apart from the impact on the focussing, is to maintain a screen structure that is easy to create using self-alignment with electron emitting elements centred in the grooves.

Figure 8:
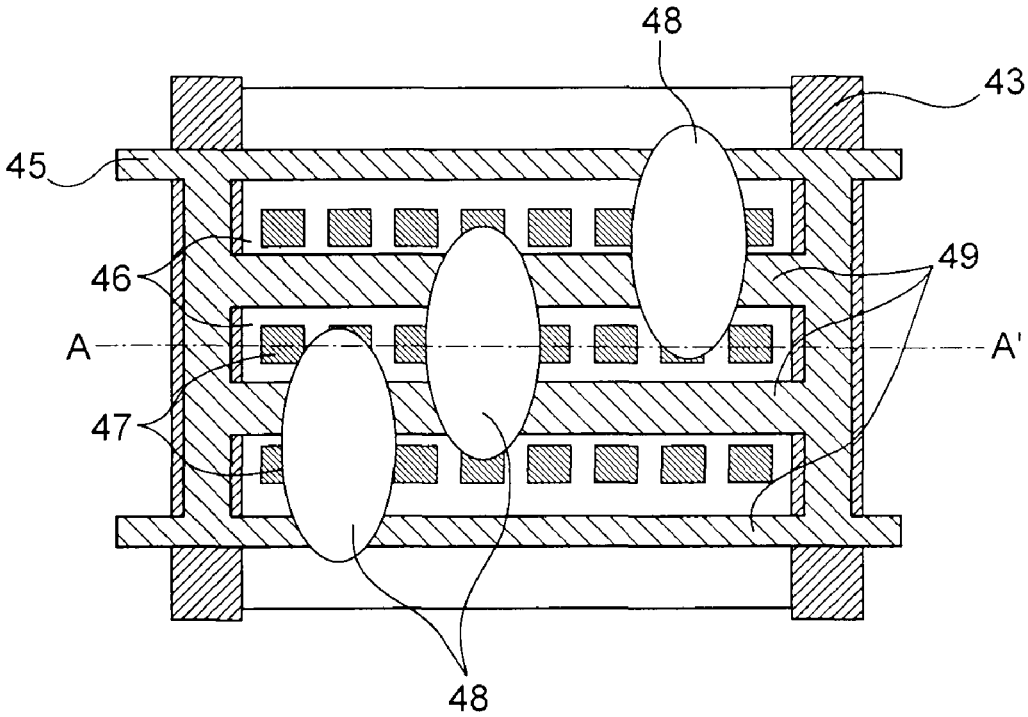
FIG. 8 is a top view of a pixel according to a second embodiment of the invention.

Nevertheless, if desired, it is possible to accentuate further the focussing effect by offsetting the electron emitting elements in the slots increasingly the closer they are to the edge of the pixel, wherein the offsetting consists of bringing the rows of emitting elements of the band closer to the AA' axis. This is shown in FIG. 8 where the same elements as in FIG. 6 have the same references. In this figure, the bands 49 are of equal widths and, when moving further away from the AA' axis, the rows of electron emitting elements are increasingly offset towards the AA' axis.

It is also possible to combine the two embodiments previously described.

Figure 9:
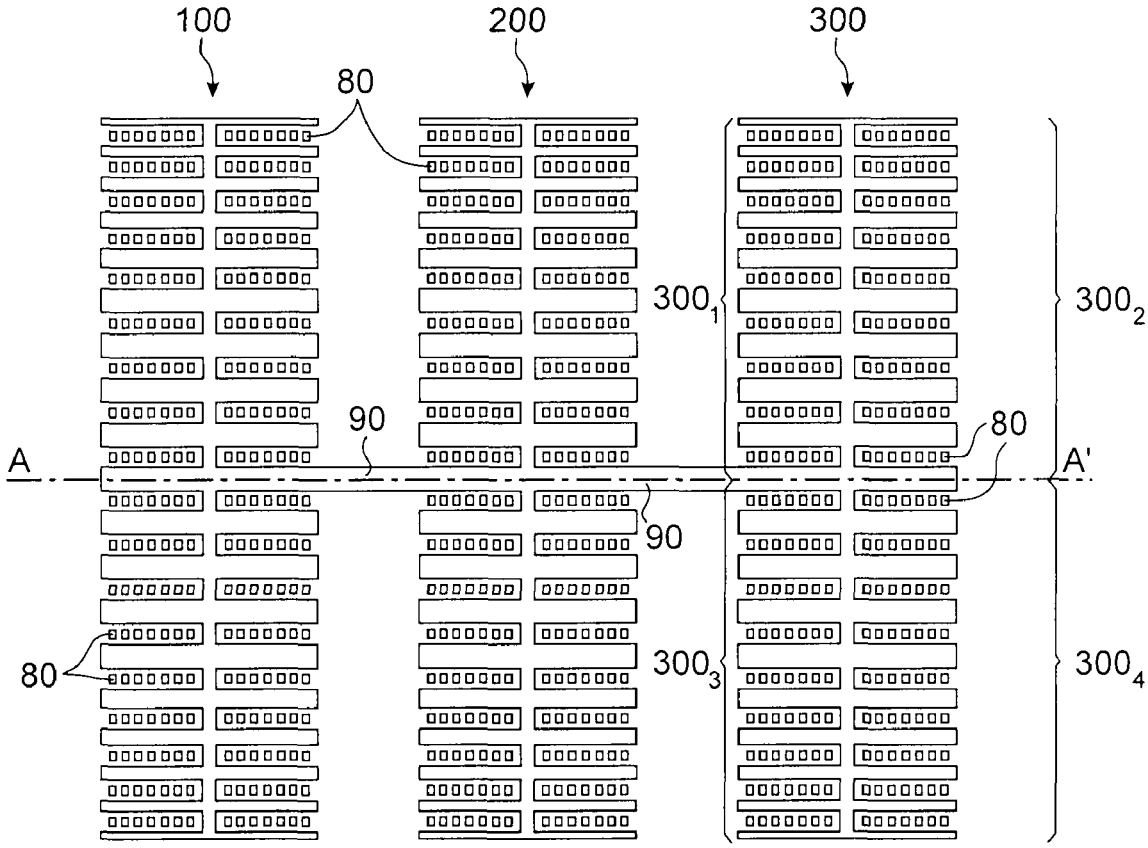
FIG. 9 is a top view of a flat colour viewing screen pixel according to the invention.

FIG. 9 illustrates one example of an embodiment of the invention for a colour pixel of a flat viewing screen. The pixel comprises three sub-pixels: a sub-pixel for the red colour, a sub-pixel for the green colour and a sub-pixel for the blue colour. In the figure, for reasons of simplification, only the gate electrodes 100, 200 and 300 of each sub-pixel, as well as the electron emitting elements 80, are shown. Connections 90 connect electrically the three sub-pixels. The connections 90 are positioned along the central axis AA' of the pixel to avoid creating divergent lateral electrical fields. As the sub-pixels 100, 200 and 300 are identical, only the sub-pixel 300 will now be described in more detail.

As shown in FIG. 9, a sub-pixel such as the sub-pixel 300 comprises four identical parts positioned symmetrically with respect to the centre of the sub-pixel $\mathbf{300}_1$, $\mathbf{300}_2$, $\mathbf{300}_3$ and $\mathbf{300}_4$.

Figure 10:
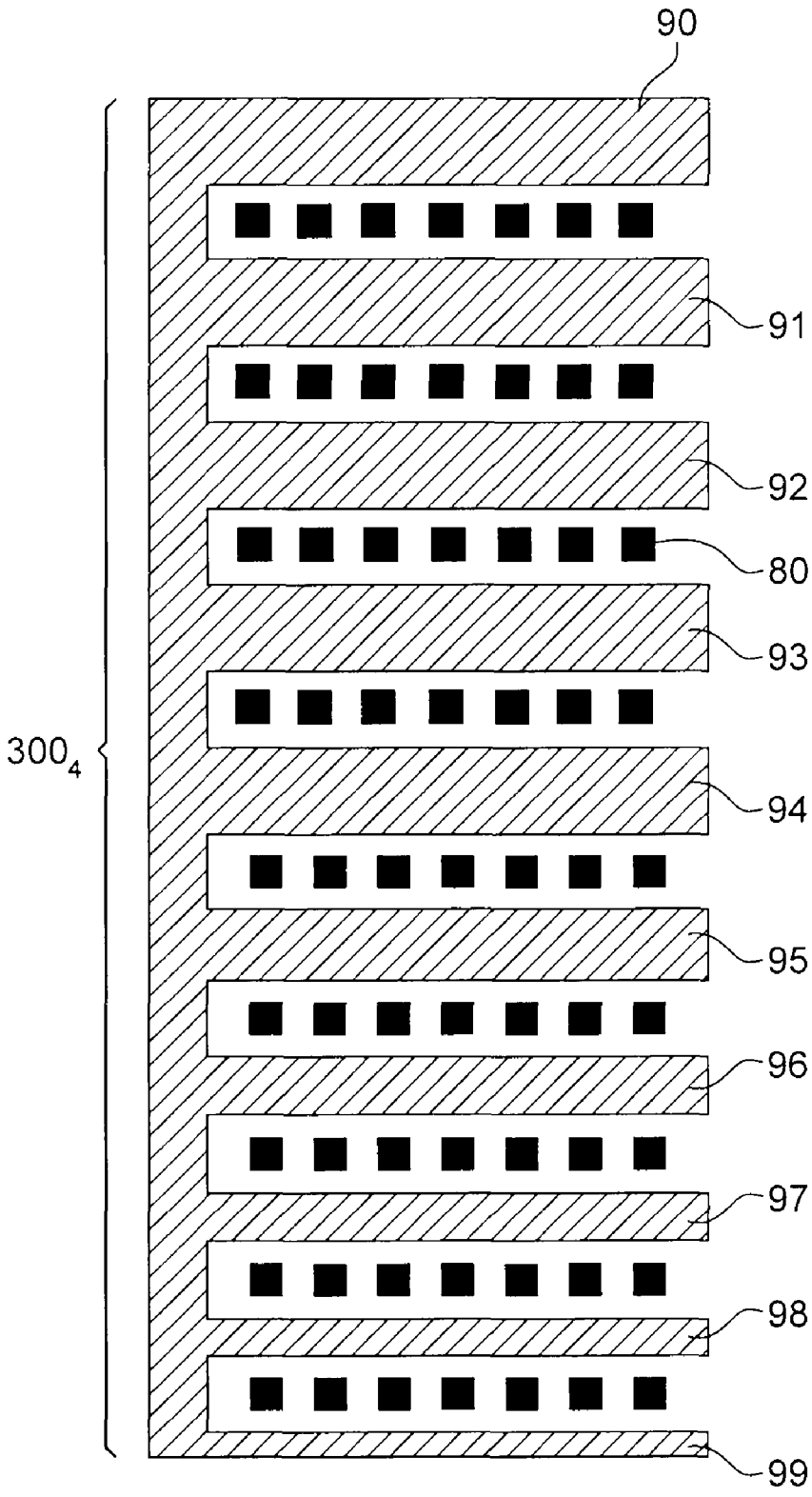
FIG. 10 is a partial view of the pixel of FIG. 9, FIGS. 11A to 11D are transversal cross sectional views illustrating one embodiment of the present invention.

FIG. 10 shows one of the four parts $\mathbf{300}_4$ of the sub-pixel 300. The part $\mathbf{300}_4$ is formed by the electrode band 90 (common to the part $\mathbf{300}_2$) and successive electrode bands 91 to 99. In this example of embodiment, the width of the bands complies with the profile illustrated by FIG. 7. Consequently, bands 90 to 94 have a width of 13 μm, band 95 has a width of 11 μm, band 96 has a width of 9 μm, band 97 has a width of 7 μm, band 98 has a width of 5 μm and band 99 has a width of 3 μm. The rows of electron emitting elements 80 are positioned symmetrically between two adjacent bands. The distance separating two adjacent bands is for example 12 μm.

FIGS. 11A to 11D are transversal cross sectional views illustrating an embodiment of the present invention.

Figure 11A:
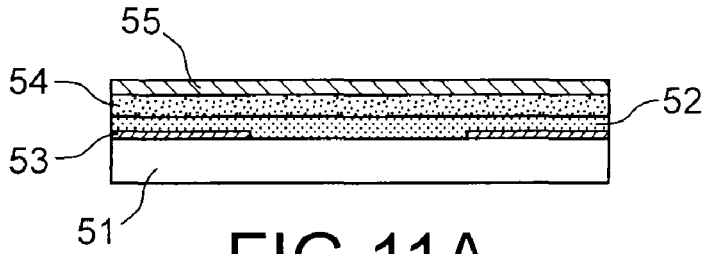
Figure 11B:
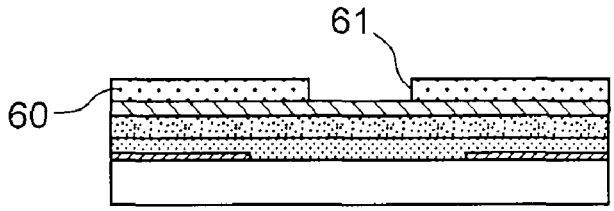

FIG. 11A shows a substrate 51, for example made of glass, on which are deposited and etched cathode conductors 53 which may be made of molybdenum or an alloy of tungsten and titanium and which represent the columns of the screen. Next are successively deposited a ballast layer 52 in amorphous silicon of a thickness of between 0.5 and 2 μm, an electrically insulating layer 54 of silica of a thickness of between 1 and 3 μm and a metallic layer 55, made of molybdenum or copper, designed to form the electron extraction gate.

A layer of resin 60 is then deposited on the structure obtained. Openings are made in the resin to define the lines of the screen and the gate patterns. Consequently, an opening 61 defines the size of the future electron emitting elements. The metallic layer 55 and the electrical insulating layer 54 are etched using dry reactive etching (see FIG. 11B).

Figure 11C:
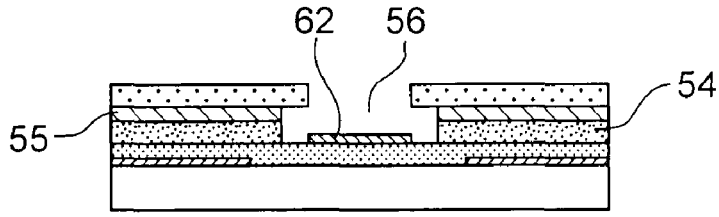

Next, the layers 55 and 54 are wet etched and the recess is controlled with respect to the opening 61 of the resin layer 60. An opening 56 is obtained as shown by FIG. 11C. Via the opening 56, a pin 62 is deposited formed by a catalyser layer (typically iron, nickel or iron/silicon/palladium/nickel alloys in thicknesses of 1 to 20 nm). The pin may also be a multilayer comprising a metallic sub-layer (in TiN, TaN, Al or Ti 50 nm thick) and a catalyser layer.

Figure 11D:
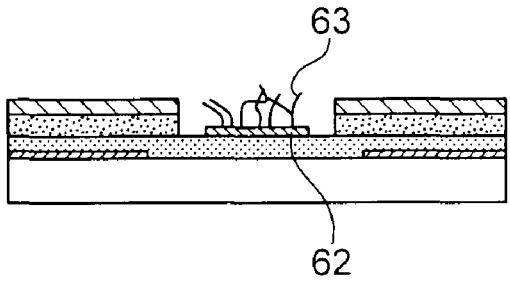

FIG. 11D shows the structure obtained after elimination of the resin followed by the growth of carbon nanotubes 63 by CVD using a pressure of 0.1 mbar of acetylene at 550° C. for 1 minute.

The invention claimed is:

1. An electron emitting structure that emits electrons by field effect, comprising:

at least one electronic emission zone indicated by a cathode electrode positioned according to a first axis and an extraction gate electrode positioned in a second axis, with an electrical insulating layer separating the cathode electrode from the gate electrode, wherein the electronic emission zone includes a plurality of electron emitting elements electrically connected to the cathode electrode, the electron emitting elements are in rows in openings in the gate electrode and the electrical insulating layer, and the gate openings are in rows between two bands of the gate electrode; and focussing means for focusing electron beams emitted by the electron emitting elements, wherein the focussing means include a dissymmetrical layout of rows of the electron emitting elements and their adjacent gate electrode bands, and the dissymmetrical layout focuses all of the electronic beams and includes a difference in width of gate electrode bands adjacent to a same gate opening so that, for this same gate opening, the adjacent band situated closest to an outside of the electronic emission zone is narrower than the adjacent band situated the closest to an inside of the electronic emission zone.

2. The electron emitting structure according to claim 1, wherein the difference in width of the bands of the gate electrode is such that the width of the bands progressively decreases from the inside towards the outside of the electronic emission zone.

3. The electron emitting structure according to claim 2, wherein the gate electrode has, in a central section of the electronic emission zone, at least one gate opening whose adjacent bands are of equal widths, wherein the electrode bands of progressively decreasing width are positioned on either side of this central section.

4. The electron emitting structure according to claim 1, wherein the dissymmetry is caused by an offset of at least one row of electron emitting elements with respect to a main axis of the gate opening corresponding to this row, wherein the offset includes said at least one row being closer to a center of the electronic emission zone.

5. The electron emitting structure according to claim 4, wherein the offset of at least one row of electron emitting elements includes several rows of electron emitting elements, wherein said offset increases progressively from the inside towards the outside of the electronic emission zone.

6. The electron emitting structure according to claim 5, wherein the gate electrode has, in a central section of the electronic emission zone, at least one gate opening whose row of electron emitting elements is centred on its main axis, wherein the rows of electron emitting elements whose offset progressively increases are positioned on either side of this central section.

7. The electron emitting structure according to any of claims 1 to 6, wherein the bands of the gate electrode are orientated according to said first axis.

8. The electron emitting structure according to any of claims 1 to 6, wherein the bands of the gate electrode are orientated according to said second axis.

9. An electron emitting structure that emits electrons by field effect, comprising:

at least one electronic emission zone indicated by a cathode electrode positioned according to a first axis and an extraction gate electrode positioned in a second axis, with an electrical insulating layer separating the cathode electrode from the gate electrode, wherein the electronic emission zone includes a plurality of electron emitting elements electrically connected to the cathode electrode, the electron emitting elements are in rows in openings in the gate electrode and the electrical insulating layer, and the gate openings are in rows between two bands of the gate electrode; and a dissymmetrical layout of rows of the electron emitting elements and their adjacent gate electrode bands, wherein the dissymmetrical layout includes a difference in width of gate electrode bands adjacent to a same gate opening so that, for this same gate opening, the adjacent band situated closest to an outside of the electronic emission zone is narrower than the adjacent band situated the closest to an inside of the electronic emission zone.

* * * * *